US009463959B2

(12) United States Patent
Hermann et al.

(10) Patent No.: US 9,463,959 B2
(45) Date of Patent: Oct. 11, 2016

(54) ADJUSTABLE MODULE LIFT FRAME ASSEMBLY

(71) Applicant: PCL INDUSTRIAL MANAGEMENT INC., Edmonton, Alberta (CA)

(72) Inventors: Ulrich (Rick) Hermann, Edmonton (CA); Jacek Olearczyk, Edmonton (CA)

(73) Assignee: PCL INDUSTRIAL MANAGEMENT INC., Edmonton, Alberta (CA)

( * ) Notice: Subject to any disclaimer, the term of this patent is extended or adjusted under 35 U.S.C. 154(b) by 0 days.

(21) Appl. No.: 14/351,009

(22) PCT Filed: Jul. 19, 2013

(86) PCT No.: PCT/CA2013/000662

§ 371 (c)(1),
(2) Date: Apr. 10, 2014

(87) PCT Pub. No.: WO2014/043783

PCT Pub. Date: Mar. 27, 2014

(65) Prior Publication Data

US 2014/0246875 A1 Sep. 4, 2014

(51) Int. Cl.
*B66C 1/16* (2006.01)
*B66C 1/22* (2006.01)

(52) U.S. Cl.
CPC .. *B66C 1/22* (2013.01); *B66C 1/16* (2013.01)

(58) Field of Classification Search
CPC ..... B66C 1/101; B66C 1/105; B66C 1/125; B66C 1/14; B66C 1/16; B66C 1/22
USPC ..... 294/67.33, 67.5, 74, 81.2, 81.3, 81.54, 294/81.56
See application file for complete search history.

(56) References Cited

U.S. PATENT DOCUMENTS

| | | | | | |
|---|---|---|---|---|---|
| 762,875 | A | * | 6/1904 | Blodgett | 294/81.55 |
| 1,834,902 | A | * | 12/1931 | Payzant | 294/67.4 |
| 1,928,213 | A | * | 9/1933 | Showers, Jr. et al. | 294/81.2 |
| 2,035,311 | A | * | 3/1936 | Galliher | 294/81.2 |
| 3,314,711 | A | * | 4/1967 | Dietz et al. | 294/67.5 |
| 3,343,861 | A | * | 9/1967 | Sinicki | 294/81.2 |
| 3,558,175 | A | | 1/1971 | Mattson | |
| 3,561,810 | A | * | 2/1971 | Newsted | 294/81.3 |
| 3,596,968 | A | * | 8/1971 | Holm | 294/81.3 |
| 3,602,544 | A | * | 8/1971 | Marsh | 294/74 |
| 4,046,414 | A | * | 9/1977 | James et al. | 294/81.5 |
| 4,185,862 | A | * | 1/1980 | Slocombe | 294/74 |
| 4,462,627 | A | | 7/1984 | Kudlicka | |
| 5,820,184 | A | * | 10/1998 | Echenay | 294/81.2 |

(Continued)

OTHER PUBLICATIONS

Northern Crane Services has invented specialized "QuikMod" module rigging (patent pending) to lift piperack modules up to 350 tons; www.NCSG.com; Nov. 2013.

*Primary Examiner* — Dean Kramer
(74) *Attorney, Agent, or Firm* — Bennett Jones LLP

(57) ABSTRACT

A module lift assembly includes first and second multipoint adapter plates separated by a horizontal transverse spreader bar; a lift frame having first and second longitudinal lift beams separated by horizontal transverse bracing; a plurality of slings of adjustable length connecting the first multipoint adapter plate to the first lift beam and connecting the second multipoint adapter plate to the second lift beam; and a plurality of slider assemblies each slidingly affixed to the first and second lift beams, and a lift shackle for attaching to a module.

27 Claims, 7 Drawing Sheets

(56) References Cited

U.S. PATENT DOCUMENTS 7,497,492 B2 * 3/2009 Gonzalez et al. ..... 294/67.5
8,317,244 B1 * 11/2012 Schuyleman ..... 294/67.5
2001/0055523 A1 12/2001 Slodden et al.
2003/0222468 A1 12/2003 Brooks
2013/0020818 A1 1/2013 Parker

* cited by examiner

ADJUSTABLE MODULE LIFT FRAME ASSEMBLY

FIELD OF THE INVENTION

The present invention is directed to a module lift frame which is conveniently adjustable to accommodate modules with a variable number of lift points, range of module lengths and widths, and off-centre centre of gravity.

BACKGROUND

Heavy industrial plants, particularly in the bitumen, heavy oil and petrochemical industries are increasingly being constructed using pre-fabricated modules. A standard module comprises a structural steel frame, and may be 20 feet wide, 80 to 120 feet long, and up to 24 feet high, with weights ranging from 50 to 160 metric tons.

Conventionally, these modules are lifted and installed using cranes and rigging assemblies such as that shown in FIG. 1 (Prior Art). However, as the centre of gravity of the module may not coincide with the physical centre of the module, the rigging must be adjusted so that the module can be lifted with substantially equal tension in the rigging components. The large number of spreader bars, slings and shackles introduce a large number of potential pinch points, each of which carries a potential injury site. The complexity of the rigging causes lengthy delays while adjusting for the module centre of gravity and pick point configurations. The rigging does not provide any stiffness to the module causing significant stresses within the module for unequally loaded modules.

Therefore, there is a need in the art for a module lift frame which mitigates the difficulties of the prior art.

SUMMARY OF THE INVENTION

In one aspect, the invention may comprise a module lift assembly comprising:

(a) a lift assembly comprising a first and second multipoint adapter plates separated by a horizontal transverse spreader bar;

(b) a lift frame comprising first and second longitudinal lift beams separated by horizontal transverse bracing;

(c) a plurality of slings connecting the first multipoint adapter plate to the first lift beam and connecting the second multipoint adapter plate to the second lift beam, wherein each sling comprises a member of adjustable length; and (d) a plurality of slider assemblies each having a first end slidingly affixed to the first and second lift beams, and a second end comprising a lift shackle for attaching to a module.

In another aspect, the invention may comprise a method of lifting a module having a centre-of-gravity (COG) using a module lift assembly having two longitudinal, spaced apart lift beams, comprising the steps of:

(a) attaching the module to the lift beams using slider assemblies attached to the lift beams;

(b) sliding the slider assemblies in the longitudinal direction and adjusting the relative vertical position of the lift beams until the module COG is centred under the lift assembly.

BRIEF DESCRIPTION OF THE DRAWINGS

In the drawings, like elements are assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention. The drawings are briefly described as follows.

DETAILED DESCRIPTION OF PREFERRED EMBODIMENTS

The invention relates to an adjustable module lift frame assembly. When describing the present invention, all terms not defined herein have their common art-recognized meanings. the extent that the following description is of a specific embodiment or a particular use of the invention, it is intended to be illustrative only, and not limiting of the claimed invention. The following description is intended to cover all alternatives, modifications and equivalents that are included in the spirit and scope of the invention, as defined in the appended claims.

Figure 1:
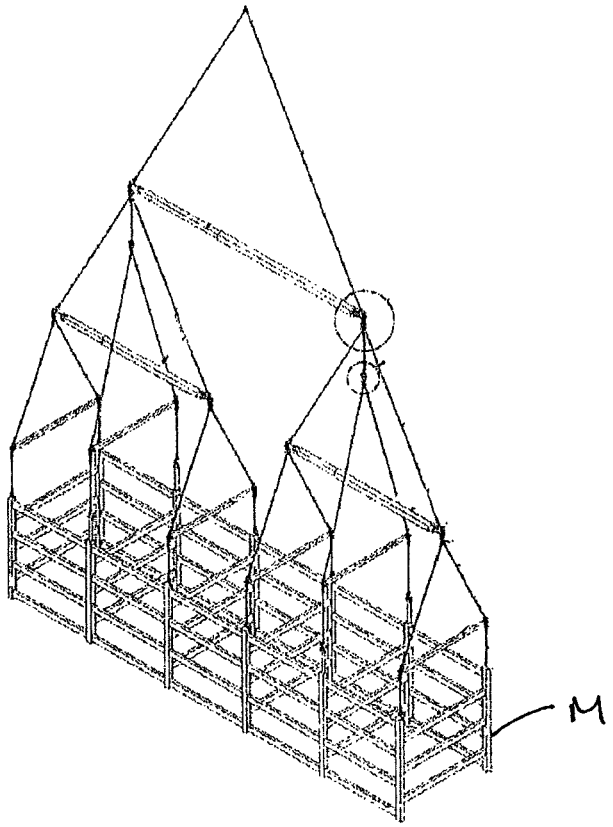
FIG. 1 PRIOR ART
FIG. 1 is diagram of a prior art module lift rigging.

As shown in FIG. 1, a prior art rigging assembly includes spreader bars oriented in both the longitudinal and transverse directions. Adjusting the rigging to accommodate a non-centred centre of gravity (COG) involves multiple adjustments of various rigging components.

In one embodiment of the present invention, a module (M) lift frame assembly comprises:

(a) an upper lift assembly comprising a first and second multipoint adapter plates (10, 12) separated by a transverse spreader bar (14);

(b) a lift frame comprising first and second longitudinal lift beams (20, 22) separated by transverse bracing (24) and diagonal bracing (26);

(c) a plurality of slings (30) connecting the first multipoint adapter plate (10) to the first lift beam (20) and connecting the second multipoint adapter plate (12) to the second lift beam (22), wherein each sling (30) comprises a member of adjustable length (40); and (d) a plurality of slider assemblies (50) each having a first end (52) slidingly affixed to either the first or second lift beams (20, 22), and a second end (54) comprising a lift shackle (56) for attaching to the module (M) being lifted.

The upper lift assembly connects to a crane hook (5) which is attached by wire rope to either end of the transverse spreader bar (14). First and second multipoint adapter plates (10, 12) are attached to lift ears (101) disposed at the ends of the transverse spreader bar (14).

Figure 3:
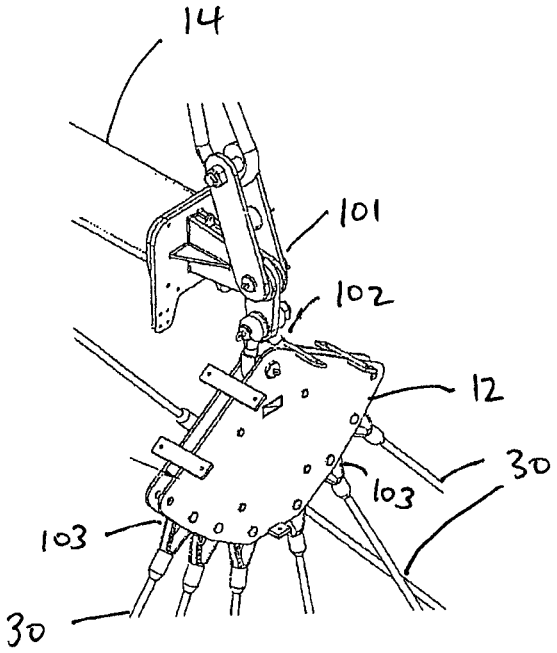
FIG. 3 shows a detail of FIG. 2, showing one embodiment of a multipoint adapter plate.
Figure 4:
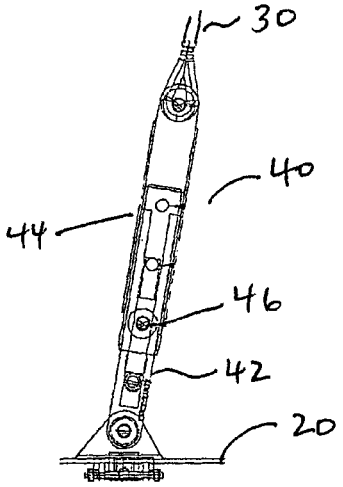
FIG. 4 shows one embodiment of an adjustable length member for attachment between one embodiment of the slings and the lift beam.
Figure 5:
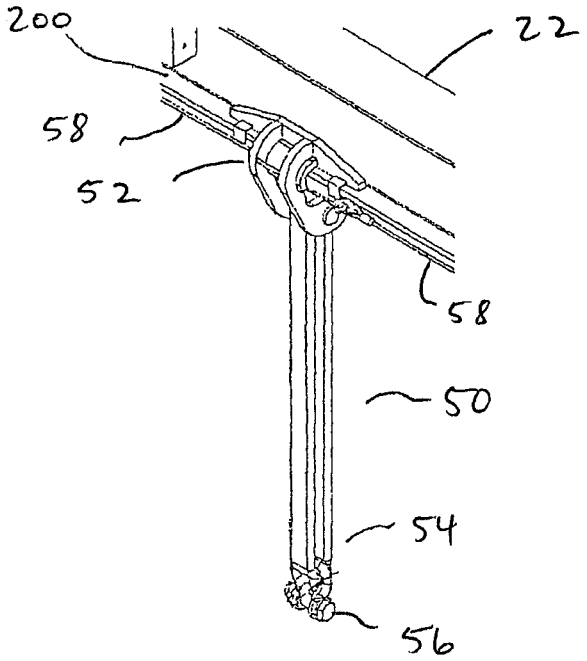
FIG. 5 shows one embodiment of a slider assembly.

In one embodiment, each multipoint adapter plate (10, 12) comprises a pair of parallel plates spaced apart with pins or bolts. Each adapter plate has an apex which accepts and hangs from a shackle (102) connected to the lift ear (101). A plurality of sling attachments (103) are arrayed in an arc opposite the apex, as may be seen in FIG. 3.

The lift frame comprises first and second horizontal longitudinal lift beams (20, 22) separated by transverse bracing (24) and diagonal bracing (26). In one embodiment, the longitudinal lift beams comprise I-beams or double web beams having a lower flange (200). Each lift beam may be a single unitary beam or may comprise multiple interconnected lift beams. The lift frame is connected to the adapter plates (10, 12) by a plurality of slings (30) connecting the first multipoint adapter plate (10) to the first lift beam (20), and a plurality of slings (30) connecting the second multipoint adapter plate (12) to the second lift beam (22). Each length of sling (30) may comprise a number of sling segments interconnected with intermediate shackles (32) or connector plates, and are attached to an upper surface of each lift beam. Preferably, the lift assembly comprises an even number of slings, equally distributed between the first and second adapter plates and lift beams. Preferably, the slings attach to the lift beams in fixed positions, spaced in equidistant manner along the length of the lift beams.

Each sling (30) further comprises at least one member of adjustable length (40). In a preferred embodiment, the adjustable length member (40) comprises a telescoping rod (42) and tube (44), or flat bar and rectangular shell arrangement, which may be fixed with a removable pin (46) in various positions. Secondary length adjustment may be provided by a turnbuckle (48) which may be connected to the sling immediately above or below the adjustable length member (40).

Each lower flange of each lift beam (20, 22) supports a plurality of slider assemblies (50), which each have a first end (52) slidingly affixed to the lift beam (20, 22) lower flanges, and a second end (54) comprising a lift shackle (56). The lift shackle (56) provides the connection to the module (M) being lifted.

As will be apparent to one skilled in the art, the number and placing of the slider assemblies is dependent upon the module (M) being lifted. In one exemplary embodiment shown in FIG. 2, the module (M) comprises 6 columns along each longitudinal side, therefore, there are 6 slider assemblies on each lift beam, each of which connects to a column.

In one embodiment, the slider assemblies on each lift beam are linearly interconnected by means of cables (58) or rods, so that the slider assemblies move in unison along the length of the lift beam. In other words, the distance between adjacent slider assemblies remains constant as they are moved along the lift beam.

In one embodiment, the lift assembly may comprise a plurality of legs (70) along the lift beams (20, 22) upon which the lift assembly may rest upon for storage when the assembly is not in use. These legs may be permanently attached in a position which does not interfere with the use of the assembly, or may be detachable.

Figure 2:
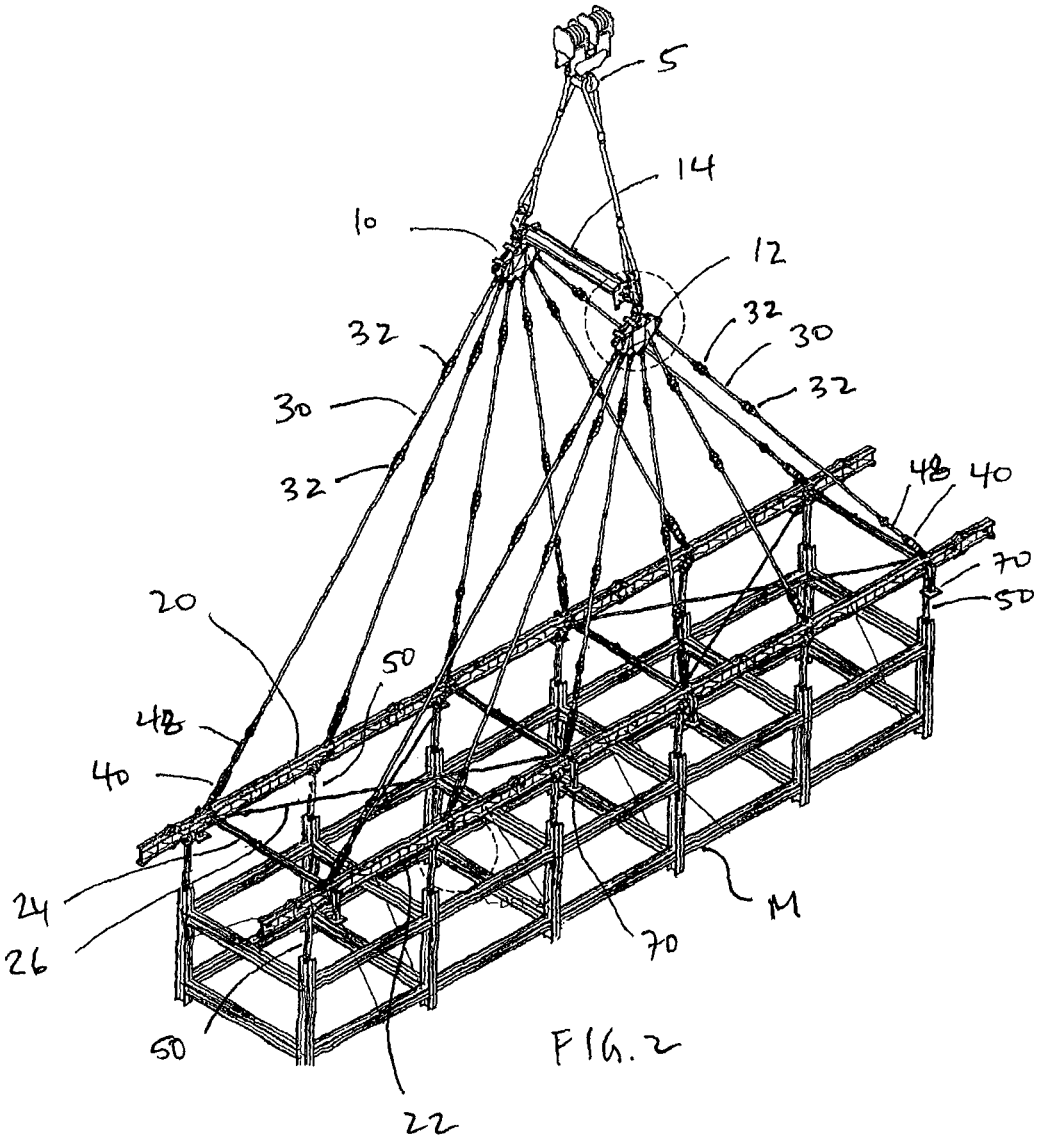
FIG. 2 shows one embodiment of a module lift assembly of the present invention.

In the embodiment illustrated in FIG. 2, the lift beams (20, 22) are of unitary construction. In alternative embodiments, the lift beams may be multi-component spliced beams, which may provide the ability to shorten or lengthen the lift beams as necessary or desired.

In operation, the lift assembly may be adjusted so as to place the COG of the module (M) immediately below (vertically aligned) with the centre of the upper lift assembly, which will be the midpoint of the spreader bar (14).

Figure 6:
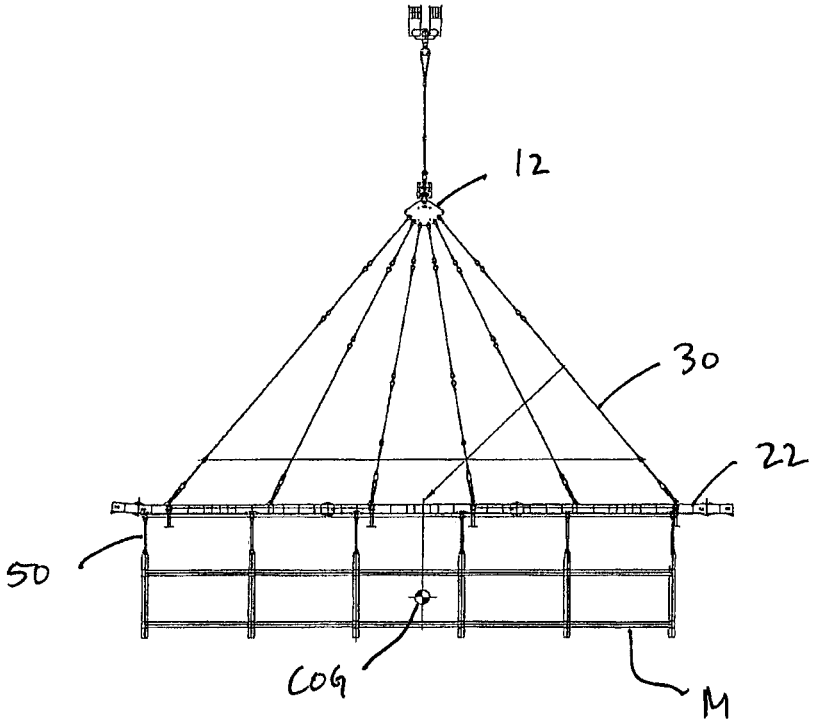
FIG. 6 shows a side view of the adjustment of the slider assemblies for a module having an offset centre of gravity.

In the longitudinal direction, this may be accomplished by moving the sliding assemblies along each lift beam until the COG of the module is vertically aligned with the apex of the first and second adapter plates, as is shown in FIG. 6.

Figure 7:
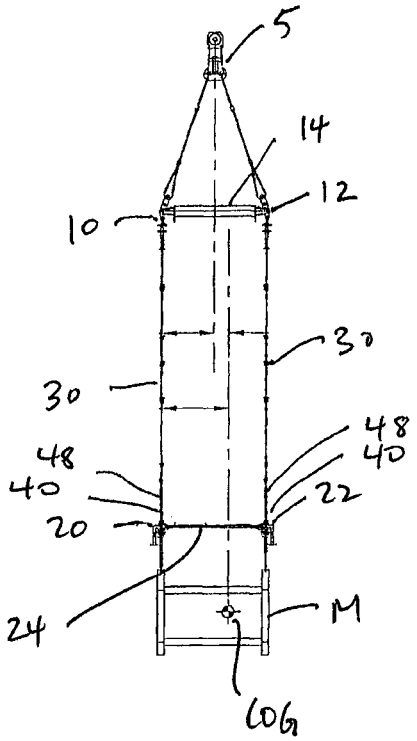
FIG. 7 shows an end view of the assembly before adjustment of the length of the sling assemblies for a module having an offset centre of gravity.

In the transverse direction, this may be accomplished by lengthening or shortening the slings along each lift beam. As may be seen in FIG. 7, the COG of the module may be shifted towards the midpoint of the spreader bar (14) by shortening those slings attached between the first adapter plate (10) and the first lift beam (20) and/or lengthening those slings attached between the second adapter plate (12) and the second lift beam (22). This shortening or lengthening the slings attached to a lift beam will modify the relative vertical position of a lift beam, as compared to the other lift beam.

As will be apparent to those skilled in the art, various modifications, adaptations and variations of the foregoing specific disclosure can be made without departing from the scope of the invention claimed herein.

What is claimed is:

1. A module lift assembly comprising:

(a) a lift assembly comprising a first and second multipoint adapter plates separated by a horizontal transverse spreader bar, wherein each multipoint adapter plate has an apex for attachment to the transverse spreader bar, and a plurality of attachment points for a plurality of slings, arrayed on an arc opposite the apex;

(b) a lift frame comprising first and second longitudinal lift beams separated by horizontal transverse bracing;

(c) a first plurality of slings connecting the first multipoint adapter plate to the first lift beam and a second plurality of slings connecting the second multipoint adapter plate to the second lift beam, wherein each sling comprises a member of adjustable length; and (d) a first plurality of slider assemblies, each having a first end slidingly affixed to the first lift beam, and a second end comprising a lift shackle for attaching to a module, and a second plurality of slider assemblies, each having a first end slidingly affixed to the second lift beam, and a second end comprising a lift shackle for attaching to the module.

2. The assembly of claim 1 wherein each sling adjustable length member comprises a telescoping rod or flat bar and tube or rectangular shell assembly.

3. The assembly of claim 2 wherein each sling further comprises a turnbuckle for secondary length adjustment.

4. The assembly of claim 1 wherein the first plurality of slider assemblies are interconnected.

5. The assembly of claim 1 wherein each multipoint adapter plate comprises a pair of spaced apart plates.

6. The assembly of claim 5 wherein each multipoint adapter plate further comprises a plurality of pins or bolts separating the pair of spaced apart plates and forming the plurality of attachment points for the plurality of slings.

7. The assembly of claim 1 wherein the horizontal transverse spreader bar comprises a lift ear disposed at each end of the transverse spreader bar, wherein each lift ear comprises a pivoting attachment to a crane hook, and a pivoting attachment to a shackle from which a different one of the multipoint adapter plates is suspended, wherein the pivoting attachments permit pivoting movement of the horizontal transverse spreader bar relative to the crane hook and the multipoint adapter plates about a horizontal axis, parallel to the lift beams.

8. The assembly of claim 7 wherein each lift ear comprises a single pivot pin as the pivoting attachment to both the crane hook and the shackle from which the different one of the multipoint adapter plates is suspended.

9. The assembly of claim 1 wherein the first lift beam comprises an upper flange and a lower flange, wherein each of the first plurality of slings is attached to the upper flange of the first lift beam, and wherein each of the first plurality of slider assemblies is supported by the lower flange of the first lift beam.

10. The assembly of claim 9 wherein the first lift beam comprises an I-beam or a double web beam.

11. A module lift assembly comprising:

(a) a lift assembly comprising a first and second multipoint adapter plates separated by a horizontal transverse spreader bar;

(b) a lift frame comprising first and second longitudinal lift beams separated by horizontal transverse bracing;

(c) a first plurality of slings connecting the first multipoint adapter plate to the first lift beam and a second plurality of slings connecting the second multipoint adapter plate to the second lift beam, wherein each sling comprises a member of adjustable length; and (d) a first plurality of slider assemblies, each having a first end slidingly affixed to the first lift beam, and a second end comprising a lift shackle for attaching to a module, and a second plurality of slider assemblies, each having a first end slidingly affixed to the second lift beam, and a second end comprising a lift shackle for attaching to the module, and wherein either the first plurality or the second plurality of slider assemblies, or both, are interconnected.

12. The assembly of claim 11 wherein each sling adjustable length member comprises a telescoping rod or flat bar and tube or rectangular shell assembly.

13. The assembly of claim 12 wherein each sling further comprises a turnbuckle for secondary length adjustment.

14. The assembly of claim 11 wherein the horizontal transverse spreader bar comprises a lift ear disposed at each end of the transverse spreader bar, wherein each lift ear comprises a pivoting attachment to a crane hook, and a pivoting attachment to a shackle from which a different one of the multipoint adapter plates is suspended, wherein the pivoting attachments permit pivoting movement of the horizontal transverse spreader bar relative to the crane hook and the multipoint adapter plates about a horizontal axis, parallel to the lift beams.

15. The assembly of claim 14 wherein each lift ear comprises a single pivot pin as the pivoting attachment to both the crane hook and the shackle from which the different one of the multipoint adapter plates is suspended.

16. The assembly of claim 11 wherein the first lift beam comprises an upper flange and a lower flange, wherein each of the first plurality of slings is attached to the upper flange of the first lift beam, and wherein each of the first plurality of slider assemblies is supported by the lower flange of the first lift beams.

17. The assembly of claim 16 wherein the first lift beam comprises an I-beam or a double web beam.

18. The assembly of claim 11 wherein each multipoint adapter plate comprises a pair of spaced apart plates, and having an apex for attachment to the transverse spreader bar, and a plurality of attachment points for a plurality of slings, arrayed on an arc opposite the apex.

19. The assembly of claim 18 wherein each multipoint adapter plate further comprises a plurality of pins or bolts separating the pair of spaced apart plates and forming the plurality of attachment points for the plurality of slings.

20. A module lift assembly comprising:

(a) a lift assembly comprising a first and second multipoint adapter plates separated by a horizontal transverse spreader bar wherein each multipoint adapter plate comprises a pair of spaced apart plates, and having an apex for attachment to the transverse spreader bar, and a plurality of attachment points for a plurality of slings, arrayed on an arc opposite the apex;

(b) a lift frame comprising first and second longitudinal lift beams separated by horizontal transverse bracing, wherein each lift beam comprises a top flange and a bottom flange;

(c) a plurality of slings connecting the first multipoint adapter plate to the top flange of first lift beam and connecting the second multipoint adapter plate to the top flange of the second lift beam, wherein each sling comprises a member of adjustable length; and (d) a first plurality of slider assemblies, each having a first end slidingly affixed to the bottom flange of the first lift beam, and a second end comprising a lift shackle for attaching to a module, and a second plurality of slider assemblies, each having a first end slidingly affixed to the bottom flange of the second lift beam, and a second end comprising a lift shackle for attaching to the module.

21. The assembly of claim 20 wherein either the first plurality or the second plurality, of slider assemblies, or both, are interconnected.

22. The assembly of claim 20 wherein the horizontal transverse spreader bar comprises a lift ear disposed at each end of the transverse spreader bar, wherein each lift ear comprises a pivoting attachment to a crane hook, and a pivoting attachment to a shackle from which a different one of the multipoint adapter plates is suspended, wherein the pivoting attachments permit pivoting movement of the horizontal transverse spreader bar relative to the crane hook and the multipoint adapter plates about a horizontal axis, parallel to the lift beams.

23. The assembly of claim 22 wherein each lift ear comprises a single pivot pin as the pivoting attachment to both the crane hook and the shackle from which the different one of the multipoint adapter plates is suspended.

24. The assembly of claim 20 wherein the first and second lift beam comprise an I-beam or a double web beam.

25. The assembly of claim 20 wherein each multipoint adapter plate further comprises a plurality of pins or bolts separating the pair of spaced apart plates and forming the plurality of attachment points for the plurality of slings.

26. A method of lifting a module having a centre-of-gravity (COG) using a module lift assembly having two longitudinal, transversely spaced apart lift beams, comprising the steps of:

(a) attaching the module to the lift beams using slider assemblies attached to the lift beams wherein the slider assemblies along each lift beam are interconnected;

(b) sliding the interconnected slider assemblies along each lift beam in unison in the longitudinal direction until the module COG is centered longitudinally under the lift assembly; and (c) adjusting the relative vertical position of the lift beams until the module COG is centered transversely under the lift assembly.

27. The method of claim 26 wherein the slider assemblies may slide along the length of the lift beam without physical obstruction.

* * * * *